United States Patent [19]

Lysenko et al.

[11] Patent Number: 4,624,757

[45] Date of Patent: Nov. 25, 1986

[54] ELECTROCATALYTIC METHOD FOR PRODUCING QUINONE METHIDES

[75] Inventors: Zenon Lysenko; Eric E. Bancroft, both of Midland, Mich.

[73] Assignee: The Dow Chemical Company, Midland, Mich.

[21] Appl. No.: 816,501

[22] Filed: Jan. 6, 1986

[51] Int. Cl.[4] ..... C07B 29/06; C07C 49/64

[52] U.S. Cl. ..... 204/78; 204/59 R; 204/72; 204/73 R; 204/74; 204/75

[58] Field of Search ..... 204/59 R, 72, 73, 74, 204/75, 78

[56] References Cited

U.S. PATENT DOCUMENTS

| | | | |
|---|---|---|---|
| 2,940,988 | 6/1960 | Coppinger | 260/396 |
| 3,102,124 | 8/1963 | Mitchell | 260/396 |
| 3,291,837 | 12/1966 | Goldberg et al. | 260/591 |
| 3,592,748 | 7/1971 | Wehrli | 204/78 |
| 3,616,323 | 10/1971 | Covitz | 204/78 |
| 3,758,391 | 9/1973 | Anderson et al. | 204/78 |
| 3,894,094 | 7/1975 | Rutledge | 260/620 |
| 3,897,319 | 7/1975 | Anderson et al. | 204/78 |
| 3,925,172 | 12/1975 | Voorhies | 204/74 |
| 3,937,741 | 2/1976 | Greco | 204/74 |
| 4,032,547 | 6/1977 | Bacha et al. | 260/396 N |
| 4,056,539 | 11/1977 | Greenwald | 260/326.14 N |
| 4,061,548 | 12/1977 | Jones et al. | 204/78 |
| 4,203,811 | 5/1980 | Cramer | 204/78 |
| 4,311,565 | 1/1982 | Bersier et al. | 204/73 R |
| 4,394,227 | 7/1983 | Jäger et al. | 204/73 R |
| 4,421,613 | 12/1983 | Goodridge et al. | 204/59 R |
| 4,518,535 | 5/1985 | Naarmann et al. | 260/438.1 |
| 4,554,389 | 11/1985 | Shin et al. | 566/722 |
| 4,582,942 | 4/1986 | Comninellis et al. | 204/59 R |

*Primary Examiner*—Arthur P. Demers

[57] ABSTRACT

A method for producing quinone methides by the electrocatalytic oxidation of bis(4-hydroxyphenyl)methanes using 2,3-dichloro-5,6-dicyano-1,4-benzoquinone (DDQ) as the oxidant. Spent oxidant, in the form of $DDQH_2$, may be recycled and electrochemically regenerated to active DDQ oxidant.

7 Claims, No Drawings

ELECTROCATALYTIC METHOD FOR PRODUCING QUINONE METHIDES

BACKGROUND OF THE INVENTION

The present invention relates to a method for the production of quinone methides, and more particularly, it relates to a method for electrocatalytically oxidizing bis(4-hydroxyphenyl)methanes with 2,3-dichloro-5,6-dicyano-1,4-benzoquinone (DDQ) to produce hydroxyphenyl quinone methides.

Quinone methides are known to be useful as antioxidants as taught by Coppinger U.S. Pat. No. 2,940,988. Coppinger discloses the oxidation of dihydroxydiphenylmethane with lead dioxide or lead tetraacetate to produce a free radical which is subsequently reduced to quinone methide. Reference is also made to Bacha U.S. Pat. No. 4,032,547 which discloses an oxidation process for preparing quinone alkides from the corresponding tri-alkyl or phenyl hindered phenols. The oxidizing agent of Bacha is ferricyanide as the secondary oxidant in combination with persulfate as the primary oxidant.

Quinone methides are also useful starting materials in the preparation of dihydroxybenzophenones, as disclosed in our copending application Ser. No. 816,502. The dihydroxybenzophenones may, in turn, be used as light stabilizing agents and precursors for epoxy resins, polycarbonate resins, and other thermoplastics.

While prior art methods of preparing quinone methides exist, to date those methods have not found significant commercial utility because of their cost, inefficiencies, or other drawbacks. Accordingly, the need exists for a process by which large quantities of quinone methides can be produced economically and at high yields.

SUMMARY OF THE INVENTION

In accordance with the present invention, there is provided a method for economically producing large amounts of quinone methide of the type

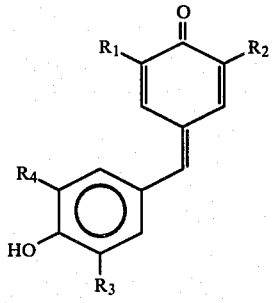

(I)

where $R_1$, $R_2$, $R_3$ and $R_4$ are either alike or different and are hydrogen, straight or branched chain alkyl moieties, cyclic alkyl compounds, halogen compounds, hydroxy and methoxy groups, and combinations thereof.

The instant method for preparing quinone methides of this type involves the oxidation of bis(4-hydroxyphenyl)methanes having the formula

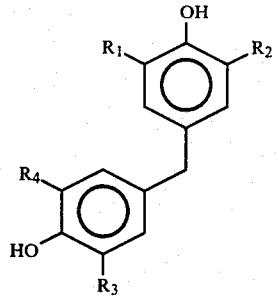

(II)

where $R_1$, $R_2$, $R_3$ and $R_4$ are as in formula (I).

The oxidant used to oxidize the bis(4-hydroxyphenyl)methanes of formula (II) to the quinone methides of formula (I) is 2,3-dichloro-5,6-dicyano-1,4-benzoquinone (DDQ). It has the formula

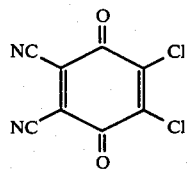

(III)

Preferably, the process is an electrocatalytic one wherein the DDQ oxidant is used in a homogeneous solution in the anode compartment of an electrochemical cell, which, for example, may contain a platinum anode. The potential applied may vary between 0.65 and 1.4 V vs. SCE, and more preferably between 0.75 and 1.2 V vs. SCE, and most preferably from 0.75–0.95 V vs. SCE. Under these conditions, the DDQ may be used in catalytic (i.e. less than stoichiometric) amounts, i.e. between 10 and 100 mole percent relative to the starting material. Likewise, since $DDQH_2$ is electrolytically oxidizable to DDQ it is possible to use $DDQH_2$ as the starting oxidant material. Since $DDQH_2$ is the form of the spent DDQ oxidant, it may be recycled and regenerated in situ in the process. It is not necessary to isolate either DDQ or $DDQH_2$ from the solution. $DDQH_2$ has the formula

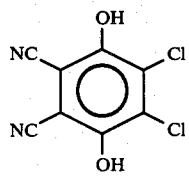

(IV)

As such, the overall electrocatalytic oxidation process can be expressed as follows:

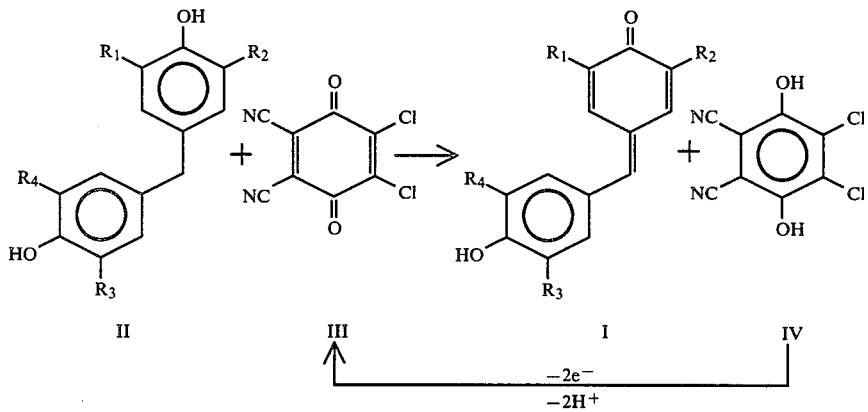

The conversion of the bis(4-hydroxyphenyl)methane of formula (II) to the quinone methide of formula (I) is accomplished by the DDQ of formula (III) acting as an oxidant in homogeneous solution with the bis(4-hydroxyphenyl)methane of formula (II). The spent oxidant, $DDQH_2$ of formula (IV) may, then, be recycled and regenerated to DDQ (formula III) by electrooxidation at an electrode potential which is insufficient to directly oxidize the bis(4-hydroxyphenyl)methane of formula (II).

The result is an efficient, economical, high yield process for the production of the quinone methides of formula (II) which, as mentioned, find utility as antioxidants and starting materials for preparations of dihydroxybenzophenones which are precursors for the production of epoxy resins, polycarbonate resins, and other thermoplastics.

Accordingly, it is an object of the present invention to provide an inexpensive means to produce large quantities of quinone methides.

Other objects and advantages of the invention will become apparent from the following description and the accompanying claims.

DETAILED DESCRIPTION OF THE PREFERRED EMBODIMENTS

The preferred method is a catalytic oxidation reaction carried out in an electrochemical cell at room temperature and pressure. A divided batch electrochemical cell is fitted with working and auxiliary electrodes and a suitable reference electrode such as a saturated calomel reference electrode (SCE). The cathode (auxiliary) compartment is filled with a supporting electrolyte solution. Any number of solvent/supporting electrolyte solutions can be used so long as they provide acceptable solubilities for bis(4-hydroxyphenyl)methanes, quinone methides, DDQ, and $DDQH_2$.

The working electrode is the anode, which may be platinum, carbon or any other inert electrode material which remains stable at the oxidation potential. The anode compartment is filled with the supporting electrolyte solution and the starting materials. The required starting materials include both the oxidation catalyst and the substrate material. The working electrode is then biased to, and maintained at, a constant voltage vs. SCE using a three electrode potentiostat. During electrolysis, the anolyte solution is rapidly stirred using conventional stirring equipment.

In one embodiment, the starting oxidation catalyst placed in the anode compartment is the DDQ of formula (III). DDQ is a known oxidant as taught by U.S. Pat. Nos. 4,518,535; 4,056,539, and 3,102,124. It may be purchased from Aldrich Chemical Company. In another embodiment, it may be the $DDQH_2$ of formula (IV). In that instance, the electrolytic oxidation, at an electrode potential in the range of 0.65 to 1.4 V vs. SCE, oxidizes the $DDQH_2$ to DDQ which, then, serves as the oxidation catalyst. $DDQH_2$ is available as the reduced form of DDQ. Since $DDQH_2$ is produced by the reaction process, it is thus possible to recycle it in situ in the anode compartment. In addition, since the DDQ oxidant is regenerated in situ it may be used in non-stoichiometric quantities in the range of 10 to 100 mole percent relative to the starting substrate material and preferably on the order of 10 mole percent. As a result of all of this, a relatively inexpensive source of oxidant is utilized in the process. In addition, use of an electrocatalytic process offers energy saving advantages over an electrolytic process, for example.

The starting substrate material placed in the anode compartment is the bis(4-hydroxyphenyl)methane of formula (II). Bis(4-hydroxyphenyl)methanes of formula (II) where $R_1$, $R_2$, $R_3$ and $R_4$ are hydrogen, straight or branched chain alkyl moieties, cyclic alkyl compounds, halogen compounds, hydroxy or methoxy groups, or combinations thereof are available from Aldrich Chemical Company or Dow Chemical Company.

The starting materials are dissolved in the supporting electrolyte solution in the anode compartment and stirred during application of a constant voltage vs. SCE of between 0.65 V and 1.40 V and most preferably of approximately 0.75 V–0.95 V vs. SCE. The electrolysis is allowed to proceed until integration of the cell current indicates a passage of 2 Faradays of charge per mole of starting reactant material. At that time, the cell circuit is disconnected and the quinone methide isolated and separated. This may be accomplished by a two step process in which the solvent solution is removed from the quinone methide, $DDQH_2$ and DDQ by evaporation. The quinone methide may, then, be separated from the $DDQH_2$ and DDQ by dissolving it in a solvent which is a non-solvent for $DDQH_2$ or DDQ. For example, quinone methide can be separated from DDQ and $DDQH_2$ by dissolving the quinone methide in methylene chloride, filtering out the still solid DDQ or $DDQH_2$, and, then, re-precipitating the quinone methide.

The following example is illustrative.

EXAMPLE

This example illustrates the preparation of the quinone methide of bis(3,5-dimethyl-4-hydroxyphenyl)methane. A divided batch electrochemical cell was fitted with platinum working and auxiliary electrodes and a saturated calomel reference electrode (SCE). The cathode (auxiliary) compartment was filled with an electrolyte solution which contained 0.25M sodium acetate dissolved in one part by volume of acetic acid and four parts of acetonitrile. The anode (working) compartment was charged with one volume of water and then filled with five volumes of the electrolyte solution to which had been added 40 g. bis(3,5-dimethyl-4-hydroxyphenyl)methane and 36 g. $DDQH_2$ per liter of electrolyte to give a 10 ml solution. The anode was then biased to 0.75 volts vs. SCE. The electrolysis was continued for 148 minutes at which time current integration showed that there had passed 2 Faradays of charge per mole of bis(3,5-dimethyl-4-hydroxyphenyl)methane in the anode compartment. At that time the cell circuit was disconnected. Gas chromatographic analysis of the anolyte revealed essentially complete conversion of bis(3,5-dimethyl-4-hydroxyphenyl)methane to the corresponding quinone methide.

Additional runs were made in this system with solvent/supporting solutions containing 160 mM bis(3,5-dimethyl-4-hydroxyphenyl)methane and $DDQH_2$ from 10 to 100 mole percent relative to the bis(3,5-dimethyl-4-hydroxyphenyl)methane. Essentially quantitative conversion to the quinone methide was observed in each instance. However, if the oxidation is allowed to continue past the 2 Faraday/mole stage, conversion of the quinone methide to 3,3',5,5'-tetramethyl-4,4'-dihydroxybenzophenone takes place as disclosed in our copending application Ser. No. 816,502.

While the methods herein described constitute preferred embodiments of the invention, it is to be understood that the invention is not limited to these precise methods and that changes may be made in the method without departing from the scope of the invention, which is defined in the appended claims.

What is claimed is:

1. A process for preparing quinone methides from bis(4-hydroxyphenyl)methanes comprising electrocatalytically oxidizing a bis(4-hydroxyphenyl)methane having the formula

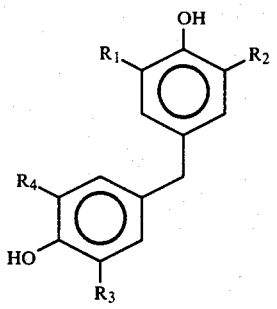

wherein $R_1$, $R_2$, $R_3$, and $R_4$ are either alike or different members selected from the group consisting of hydrogen, straight or branched chain alkyl moieties, cyclic alkyl compounds, halogen compounds, hydroxy and methoxy compounds, and combinations thereof, utilizing as an oxidant 2,3-dichloro-5,6-dicyano-1,4-benzoquinone having the formula

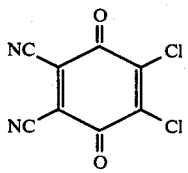

to produce spent oxidant and a quinone methide having the formula

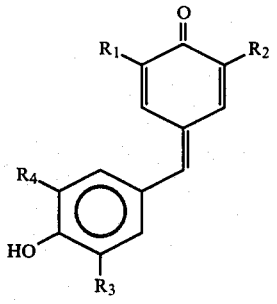

wherein $R_1$, $R_2$, $R_3$ and $R_4$ are as previously recited.

2. The process of claim 1 wherein said spent oxidant is electrochemically oxidized to its active form and recycled in the process.

3. The process of claim 1 wherein said oxidant is present in the amount of 10 to 100 mole percent relative to said bis(4-hydroxyphenyl)methane.

4. The process of claim 3 wherein said oxidant is present in the amount of approximately 10 mole percent relative to said bis(4-hydroxyphenyl)methane.

5. The process of claim 1 wherein said oxidation takes place in the presence of a platinum anode at a constant voltage of 0.65 to 1.40 V vs. SCE.

6. The process of claim 5 wherein said bis(4-hydroxyphenyl)methane is bis(3,5-dimethyl-4-hydroxyphenyl)methane.

7. The process of claim 6 wherein said oxidant is present in the amount of approximately 10 mole percent relative to said bis(4-hydroxyphenyl)methane, said constant voltage is approximately 0.75 V–0.95 vs. SCE, and said reaction is carried out until there has passed 2 Faradays of charge per mole of bis(3,5-dimethyl-4-hydroxyphenyl)methane.

* * * * *